US006984130B2

(12) United States Patent
Richter et al.

(10) Patent No.: US 6,984,130 B2
(45) Date of Patent: Jan. 10, 2006

(54) ELECTRICAL CONTACT ASSEMBLY FOR CONNECTING A BATTERY TO A CIRCUIT

(75) Inventors: Michael Richter, Schalksmühle (DE); Dirk Pellizari, Wuppertal (DE)

(73) Assignee: Lumberg Connect GmbH & Co. KG, Schalksmuhle (DE)

( * ) Notice: Subject to any disclaimer, the term of this patent is extended or adjusted under 35 U.S.C. 154(b) by 0 days.

(21) Appl. No.: 10/619,365

(22) Filed: Jul. 14, 2003

(65) Prior Publication Data

US 2004/0132319 A1 Jul. 8, 2004

(30) Foreign Application Priority Data

Aug. 23, 2002 (DE) ..... 102 38 661

(51) Int. Cl.
*H01R 12/00* (2006.01)

(52) U.S. Cl. ..... 439/66; 439/74; 439/660

(58) Field of Classification Search ..... 439/66, 439/65, 74, 660, 81, 82, 83
See application file for complete search history.

(56) References Cited

U.S. PATENT DOCUMENTS 5,746,607 A * 5/1998 Bricaud et al. ..... 439/66
5,746,626 A * 5/1998 Kwiat et al. ..... 439/630
5,980,268 A * 11/1999 Mischenko et al. ..... 439/66
5,980,323 A * 11/1999 Bricaud et al. ..... 439/630
6,000,969 A * 12/1999 Reichardt et al. ..... 439/630
6,196,883 B1 * 3/2001 Bechaz et al. ..... 439/789
6,231,394 B1 * 5/2001 Schnell et al. ..... 439/630
6,398,598 B2 * 6/2002 Masumoto ..... 439/862
6,454,607 B2 * 9/2002 Bricaud ..... 439/630
6,595,808 B2 * 7/2003 Prost et al. ..... 439/834

FOREIGN PATENT DOCUMENTS

| | | |
|---|---|---|
| DE | 33 39 080 | 2/1985 |
| DE | 198 34 375 | 12/1999 |
| GB | 833 038 | 4/1960 |

* cited by examiner

*Primary Examiner*—Tho D. Ta
*Assistant Examiner*—X. Chung-Trans
(74) *Attorney, Agent, or Firm*—Herbert Dubno; Andrew Wilford

(57) ABSTRACT

A contact assembly has a dielectric mounting block having inner and outer faces, and a conductive contact unitarily formed of elastically deformable metal. The contact has a center web set in the block, an inner leg extending from the web past the inner face and elastically deflectable toward the inner face and toward the center web, and an outer leg extending from web and elastically deflectable from an outer position spaced well outward of the outer face and spaced from the web to an inner position extending at least partially inward past the web.

6 Claims, 4 Drawing Sheets

ELECTRICAL CONTACT ASSEMBLY FOR CONNECTING A BATTERY TO A CIRCUIT

FIELD OF THE INVENTION

The present invention relates to an electrical contact assembly. More particularly this invention concerns such an assembly of the type used to connect a removable battery, e.g. in a cell phone, to an electrical circuit, e.g. a printed-circuit board.

BACKGROUND OF THE INVENTION

A standard contact assembly has a dielectric mounting block having inner and outer faces and at least one conductive contact unitarily formed of elastically deformable metal. This contact has a center web set in the block, an inner leg extending from the web past the inner face and elastically deflectable toward the inner face and toward the center web, and an outer leg extending from web and elastically deflectable from an outer position spaced well outward of the outer face and spaced from the web to an inner position closely juxtaposed with or even touching the web.

Such a contact assembly can be mounted, for example, in a wall of a cell phone, between the openable battery compartment and the interior compartment holding the phone's circuitry. Each inner leg bears on and makes permanent electrical contact with a trace of the printed-circuit board carrying this circuitry. Each outer leg can bear on a terminal of a removable battery, typically of the replaceable and rechargeable type. British patent 833,038 of R. Firman, German patent 3,338,080 of G. Muscaglione, and German patent 198 34 375 of K. Bauer describe typical such contact assemblies. Three contacts are provided normally on one mounting block to allow three electrical connections to be made to the battery.

In today's very small electronic equipment, in particular cell phones, it is important that every element be made as compact as possible. The above-described contact assemblies however cannot be reduced beyond a certain thickness, is as otherwise the outer leg at least will not bear with sufficient force against the battery terminals to form a good long-term electrical connection. The stroke of the outer leg must be maximized to ensure that it is deformed considerably in its inner contacting position, and this relatively long stroke takes up valuable space inside the device it is mounted in.

OBJECTS OF THE INVENTION

It is therefore an object of the present invention to provide an improved contact assembly.

Another object is the provision of such an improved contact assembly which overcomes the above-given disadvantages, that is which is extremely compact, yet which still forms a strong electrical connection.

SUMMARY OF THE INVENTION

A contact assembly has a dielectric mounting block having inner and outer faces, and a conductive contact unitarily formed of elastically deformable metal. The contact has a center web set in the block, an inner leg extending from the web past the inner face and elastically deflectable toward the inner face and toward the center web, and an outer leg extending from web and elastically deflectable from an outer position spaced well outward of the outer face and spaced from the web to an inner position extending at least partially inward past the web.

The ability of the outer leg to move inward past the web means that it has a substantial stroke and can therefore be built into a thinner mounting block. As a result, it can bear with quite some force on whatever it is connecting to, but still is of very compact dimensions.

The contact is further formed with inner and outer U-shaped bights connecting the respective legs to the web. In addition the bock is formed on the outer face with an inwardly directed abutment. The outer leg has a tip bearing outward on the abutment in the outer position. In fact the tip bears with prestress against the abutment so that even when only deflected slightly the outer leg will press with its prestress force on the terminal it is engaging. Unlike a tip which stands free, the outer contact according to the instant invention resists displacement from its outermost starting position with considerable force so that, even if just deflected inward a tiny bit, it will press with this considerable force on the battery terminal or other circuit element it is making an electrical connection with.

The web according to the invention is formed with a cutout through which the tip passes on movement of the outer leg from the outer position to the inner position. This cutout can be a laterally open notch, but according to a particular feature of this invention it is formed as a notch wholly bounded by the web, that is a hole. The web is substantially wider at the notch than the tip.

The bights in accordance with the invention are at opposite ends of the web and the legs extend oppositely toward each other from the respective bights. This gives the contact an S- or Z-shape. Since the two legs bend in from opposite ends, the web will not tend to cant or twist in the mounting block but instead will sit flatly therein when in use.

BRIEF DESCRIPTION OF THE DRAWING

The above and other objects, features, and advantages will become more readily apparent from the following description, reference being made to the accompanying drawing in which.

SPECIFIC DESCRIPTION

Figure 7:
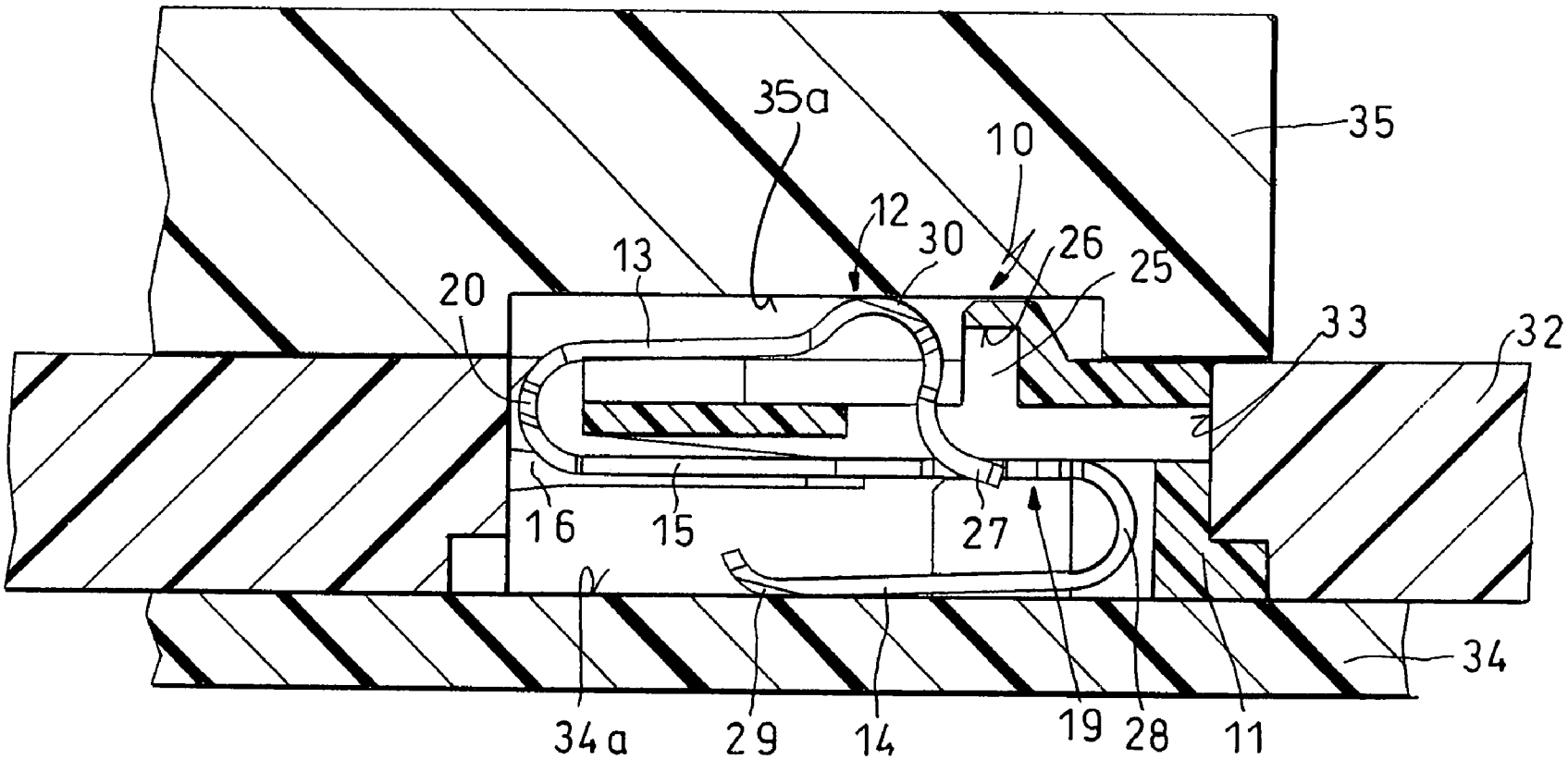
FIG. 7 is a sectional view illustrating the contact assembly in use.

As seen in FIGS. 1 through 6, a contact assembly 10 according to the invention basically comprises an injection-molded dielectric plastic mounting block 11 and three identical sheet-metal contacts 12, typically made of copper- or gold-plated steel. Here as shown in FIG. 7 the mounting block 11 is adapted to be set in a hole 33 in a wall 32 between a compartment holding a battery 35 and a compartment holding a circuit board 34. The contacts 12 each connect a respective trace 34*a* of the circuit board 34 with a respective terminal 35*a* of the battery 35.

Each contact 12 basically comprises a planar central web 15, an outer leg 13 connected to one end of the web 15 via a U-shaped bight 20, and an inner leg 14 connected to the opposite end of the web 15 by another U-shaped bight 28, all unitarily formed with each other from a bent sheet-metal stamping. The web 15 has a widened portion 18 that fits tightly in a complementary region 19 of a notch 16 of the block 11. In fact the widened portion 18 is such a tight fit that when it is forced in direction 17 (FIG. 3) into the region 19, it solidly locks the contact 12 in place.

The inner leg 14 is of fairly simple construction and has an inwardly (toward the web 15) concave outer end 29 that rides on the respective trace 34*a*. It extends from the end of the web 15 formed with the widened portion 18 and when unstressed extends at a small acute angle to the web 15 as shown in FIGS. 2, 3, 4, 5, and 6. When installed as shown in FIG. 7 it extends almost parallel to the web 16 and barely projects past an inner planar face of the block 11.

The outer leg 13 extends from the opposite end of the web 15 and has an inwardly concave contact portion 30 lying between a body portion 21 and an inwardly convex tip 27. The contact portion 30 engages the battery terminal 35. The tip 27 is only about one-third as wide as the contact portion 30 and as the web 15. The web 15 according to the invention is formed with a full-length notch or slot 31 that is slightly wider than the tip 27 so that as described below the tip 27 can pass inward through this slot 31 when the leg 13 is pressed inward.

Figure 1:
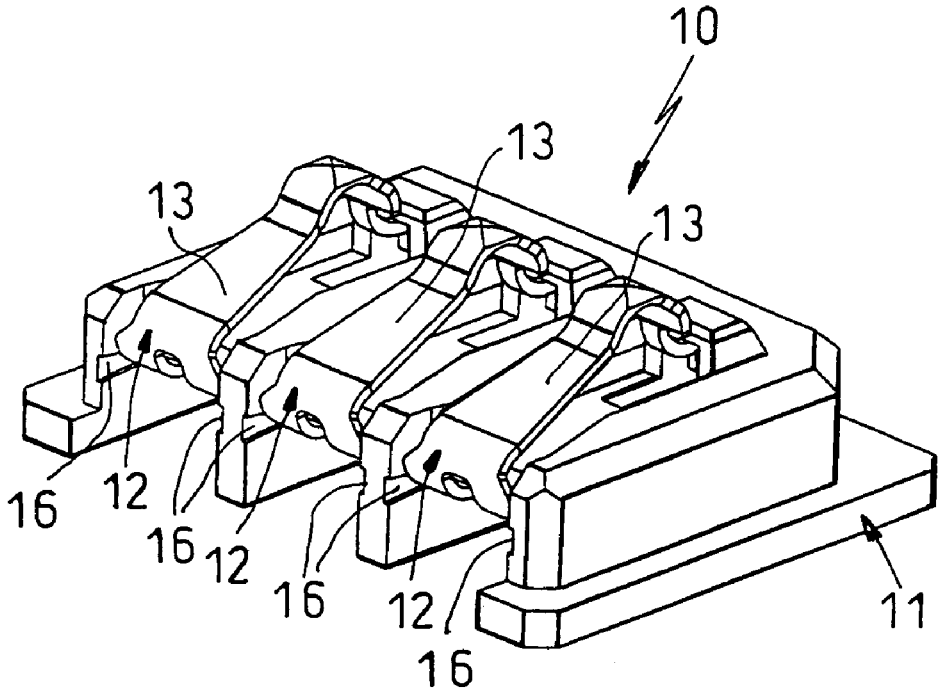
FIG. 1 is a perspective view of the contact assembly according to the invention.
Figure 2:
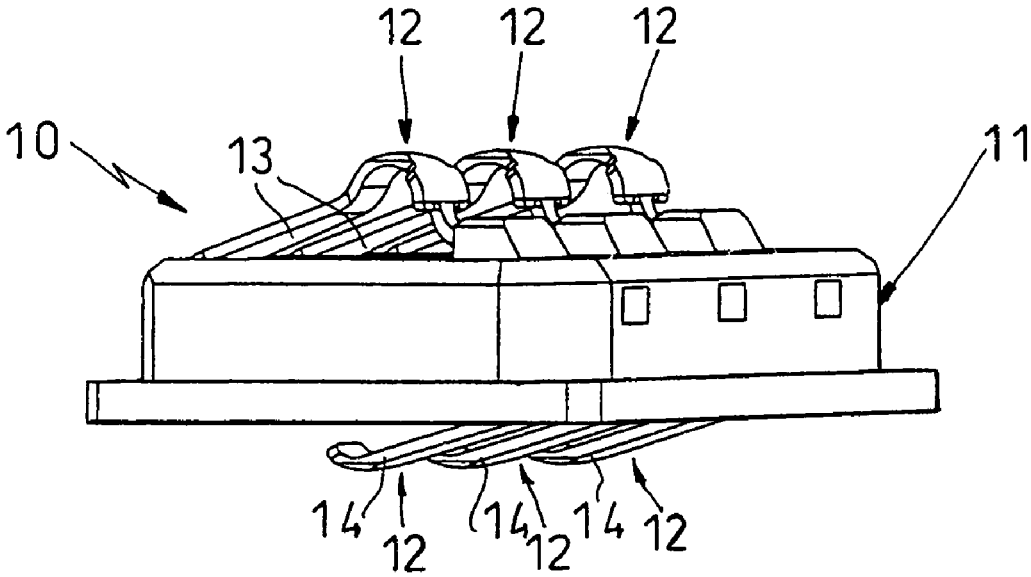
FIG. 2 is an edge view of the contact assembly.
Figure 3:
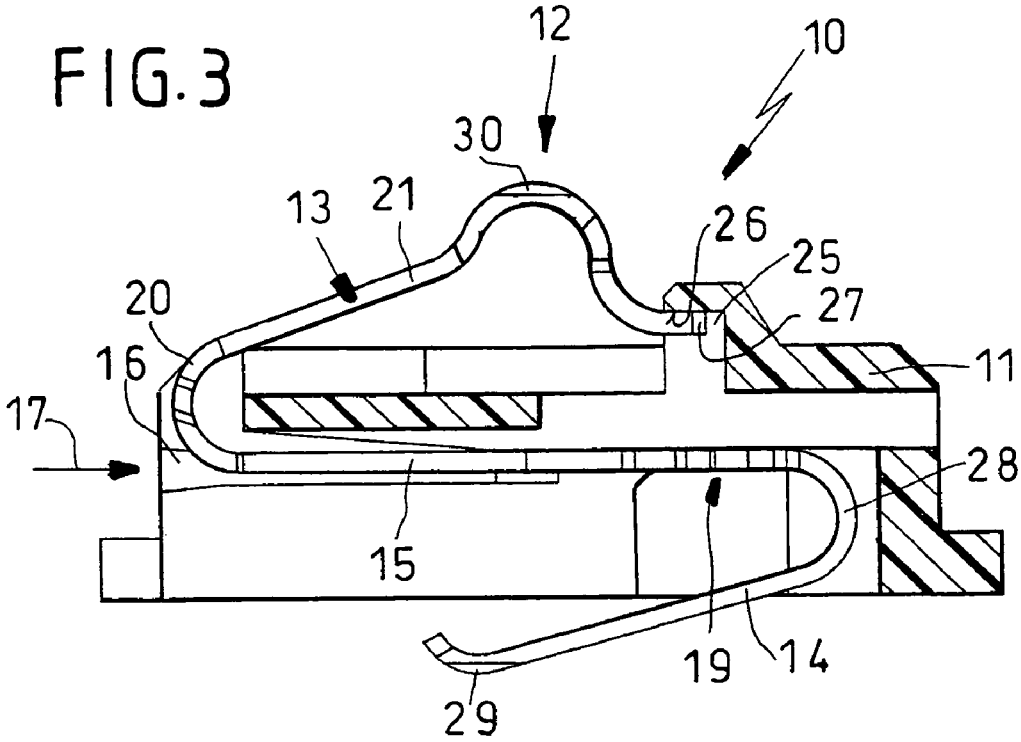
FIG. 3 is a cross section of the contact assembly.
Figure 4:
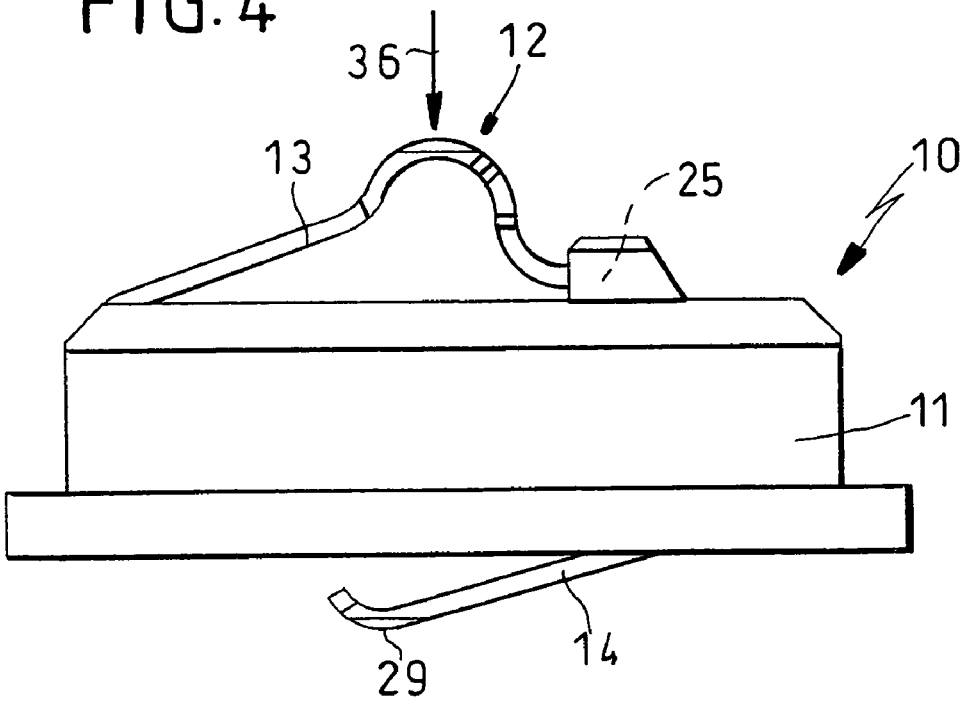
FIG. 4 is a side view of-the contact assembly.
Figure 5:
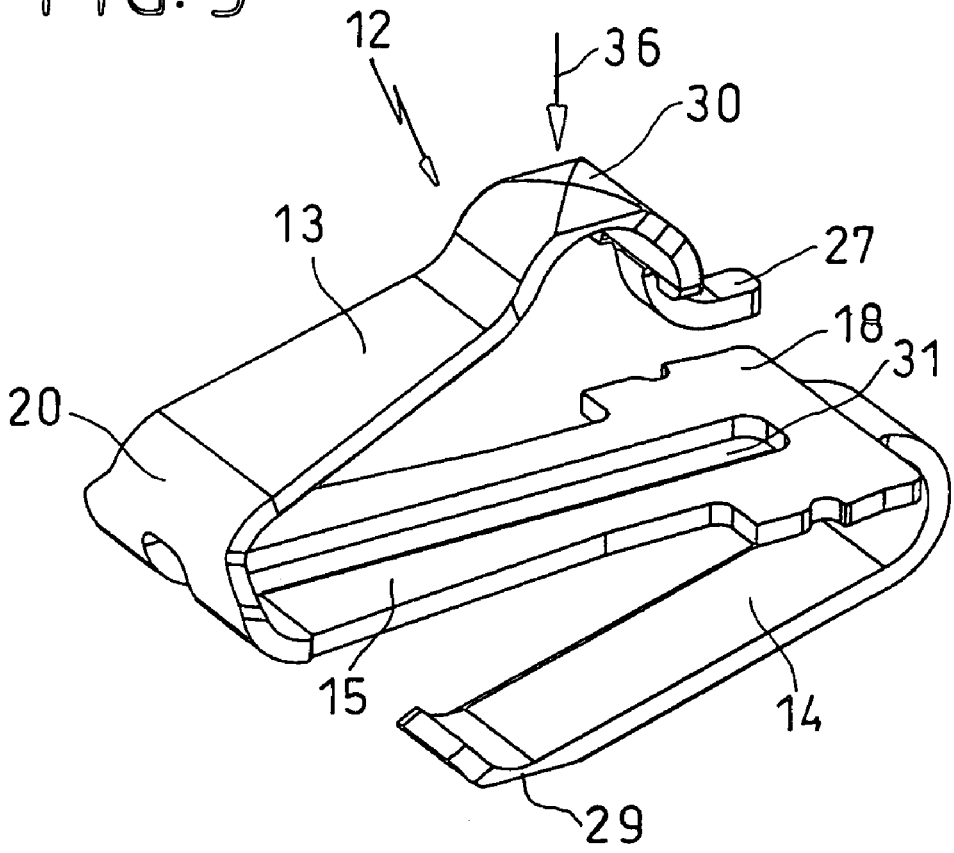
FIG. 5 is a perspective view of one of the contacts in the relaxed condition.
Figure 6:
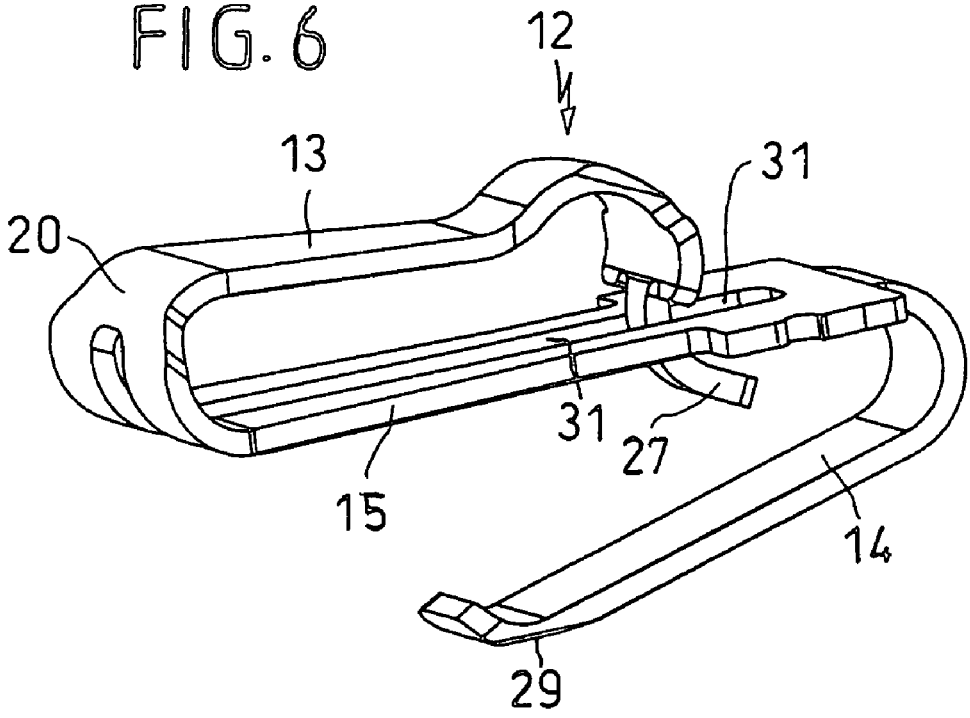
FIG. 6 is a view like FIG. 5 but with the outer leg in the inner position.

The mounting block is formed with an abutment pocket 25 having an inwardly directed surface 26 against which an outer face of the outer-leg tip 27 normally bears with some prestress. Thus as shown in FIG. 3 before a battery 35 is installed the contact portion 30 projects well past the outer face of the block 11 and the tip 27 bears with quite some force on the abutment surface 26. When a battery 35 is installed, the outer leg 13 moves inward as indicated by arrow 36 (FIGS. 4 and 5), with the tip 27 moving away from the surface 26 and eventually passing through the slot 31 in the web 15 as shown in FIG. 7.

The prestressing of the tip 27 against the surface 26 ensures that even if only deflected inward slightly, the region 30 will bear with quite some force against the battery terminal 35*a*. In addition the ability of the tip 27 to move inward past the web 15 means that the arm 12 can deform through a considerable stroke even through the entire assembly is of relatively modest thickness, measured perpendicular to the web 15.

We claim:

1. A contact assembly comprising:

a dielectric mounting block having inner and outer faces, the outer face being formed with an inwardly directed abutment; and a conductive contact unitarily formed of elastically deformable metal with a center web set in the block, having two opposite ends, and formed between the ends with a throughgoing cutout, respective inner and outer U-shaped bights concave toward each other, at the ends of the center web, and projecting oppositely from the center web, an inner leg extending from the inner bight of the web past the inner face and elastically deflectable toward the inner face and toward the center web, and an outer leg extending from the outer bight of the web toward the inner leg, elastically deflectable from an outer position spaced well outward of the outer face and spaced from the web to an inner position with the tip extending inward through the cutout and past the web, and having a tip bearing elastically outward on the abutment in the outer position, the legs extending oppositely from the respective bights toward each other.

2. The contact assembly defined in claim 1 wherein the bights are at opposite ends of the web.

3. The contact assembly defined in claim 1 wherein the block is formed on the outer face with an inwardly directed abutment, the tip bearing elastically outward on the abutment in the outer position.

4. The contact assembly defined in claim 3 wherein the tip bears with prestress against the abutment.

5. The contact assembly defined in claim 1 wherein the cutout is formed as a notch wholly bounded by the web.

6. The contact assembly defined in claim 5 wherein the web is substantially wider at the notch than the tip.

* * * * *